US005136302A

United States Patent [19]

Chin et al.

[11] Patent Number: 5,136,302

[45] Date of Patent: Aug. 4, 1992

[54] ANTENNA FOR A PORTABLE TRANSCEIVER

[75] Inventors: Melissa C. Chin, Kinnelon; James G. Evans, Colts Neck; Denis P. Orlando, Freehold, all of N.J.

[73] Assignee: AT&T Bell Laboratories, Murray Hill, N.J.

[21] Appl. No.: 658,949

[22] Filed: Mar. 18, 1991

Related U.S. Application Data

[63] Continuation of Ser. No. 388,424, Aug. 2, 1989, Pat. No. 5,030,966.

[51] Int. Cl.[5] ..... H01Q 1/24

[52] U.S. Cl. ..... 343/702; 343/900; 343/901

[58] Field of Search ..... 343/901, 702, 900, 903, 343/715

[56] References Cited

U.S. PATENT DOCUMENTS 4,860,024 8/1989 Egashira ..... 343/903

4,862,182 8/1989 Egashira ..... 343/903

*Primary Examiner*—Michael C. Wimer

*Assistant Examiner*—Hoanganh Le

*Attorney, Agent, or Firm*—Samuel R. Williamson

[57] ABSTRACT

A telescoping antenna structure suitable for use in a portable transceiver for increasing the level of radiated or received r-f energy while in a collapsed position and also obtaining the maximum permitted level of radiated r-f energy while in an extended position. The increase in r-f energy in the antenna while in the collapsed position is obtained through use of a projectable sliding member affixed to the antenna which comes in contact with and makes electrical changes to antenna tuning circuitry when the antenna is adjusted from the extended position to the collapsed position.

2 Claims, 5 Drawing Sheets

ANTENNA FOR A PORTABLE TRANSCEIVER

This is a continuation of application Ser. No. 388,424 filed Aug. 2, 1989, now U.S. Pat. No. 5,030,966.

BACKGROUND OF THE INVENTION

1. Technical Field

This invention relates generally to an antenna structure for use in a portable transceiver and more particularly for use in a transceiver for a portable telephone.

2. Description of the Prior Art

Portable telephones have advanced to the state where many options and features previously found only on desk-top and wall-mounted telephones are now available to a customer when he or she selects a portable telephone. As a result, some new customers are now considering a portable telephone as the primary telephone for their residences.

A typical portable telephone includes an antenna, a transmitter and a receiver for communicating a radio frequency (r-f) carrier signal that is modulated by audio signals and switching signals to and from an associated base station. In most portable telephones, both the transmitter and the receiver are active at the same time and one antenna is shared for transmission and reception. This antenna is generally a telescoping whip antenna which is extended for use and retracted or collapsed when not in use.

In view of the increased reliance on the portable telephone, one area needing improvement is that which addresses the reliability of communications between the portable telephone and the associated base station when separated by their maximum operating range. When the portable telephone is physically located at or near its maximum reception range from the base station, the antenna must be extended so that a user of the portable telephone can be assured of not missing an incoming call. Some users find the need to have the antenna extended for this condition convenient and therefore at times do not extend the antenna. The problem of missed calls persists, therefore, since with the antenna collapsed, the reception range of the portable telephone is typically one-third of its range with the antenna extended.

Maximum operating range for a portable telephone is obtained when the telescoping antenna is fully extended and a resonating network or loading coil, which matches to the antenna in the fully extended position, is provided. When the antenna is collapsed, however, the resonating network that matches the antenna in the extended position does not match the antenna in the collapsed position. The user of the portable telephone therefore loses somewhat more operating range than if he or she had used a non-extendible antenna that was properly matched by the resonating network.

Such a non-extendible antenna is disclosed in U.S. Pat. No. 4,721,962, issued to Heribert Gorzel on Jan. 26, 1988. This patent describes separate transmit and receive antennas that are totally enclosed inside the housing of the portable telephone and thereby avoids any antenna parts projecting therefrom. While this antenna arrangement avoids the need to have an external antenna projecting from the portable telephone, it limits the maximum range for which the portable telephone is able to communicate with a base station simply because of the reduced antenna area available or receiving r-f energy. It is therefore desirable to have an antenna which provides the full permitted reception and operating range when in an extended position and also the best possible operating range when in a collapsed position.

SUMMARY OF THE INVENTION

In accordance with the invention, there is provided a telescoping antenna structure suitable for use in a portable transceiver for increasing the level of received and radiated r-f energy while in a collapsed position and also obtaining increased sensitivity and the maximum permitted radiated level of r-f energy while in an extended position.

In accordance with an illustrative embodiment, the antenna comprises a plurality of cylindrical interlocking sections including at least a first small diameter section and a second larger diameter section. The small diameter section is coaxially aligned with and disposed in the large diameter section when the antenna is in a collapsed position and coaxially aligned and projects outwardly from the larger diameter section in a first direction when the antenna is in an extended position. The increase in r-f energy in the antenna while in the collapsed position is obtained through use of a projectable sliding member which is illustratively arranged as attached to the small diameter section and projects outward from the larger diameter section in a second direction opposite that of the first direction when the antenna is in the collapsed position. As the antenna is adjusted from the extended position to the collapsed position, this sliding member comes in contact with and makes electrical changes to antenna tuning circuitry for increasing the level of received and radiated r-f energy.

BRIEF DESCRIPTION OF THE DRAWING

This invention and its mode of operation will be more clearly understood from the following detailed description when read with the appended drawing in which.

Throughout the drawings, the same elements when shown in more than one FIG. are designated by the same reference numerals.

DETAILED DESCRIPTION

Figure 1:
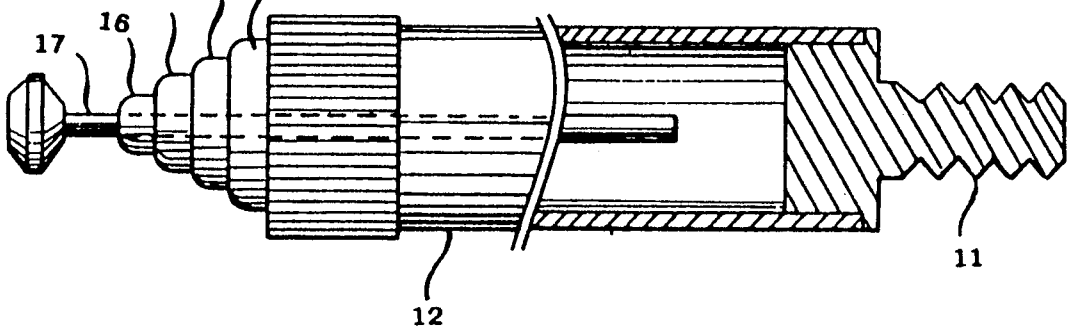
FIG. 1 (PRIOR ART)
FIG. 1 is a prior art arrangement of a telescoping antenna.

Referring now to FIG. 1, there is shown a prior art telescoping antenna typically employed in a portable transceiver. The antenna is shown in the collapsed position and has a threaded base 11 for mounting on or in the housing of a transceiver. This base 11 is affixed to the outer section 12 of multiple cylindrical interlocking sections 12 through 17. In the extended position, each smaller section of the antenna extends outward from the next larger section in which it is contained until each stop surface provided by an interlock on adjacent surfaces is encountered.

Figure 2:
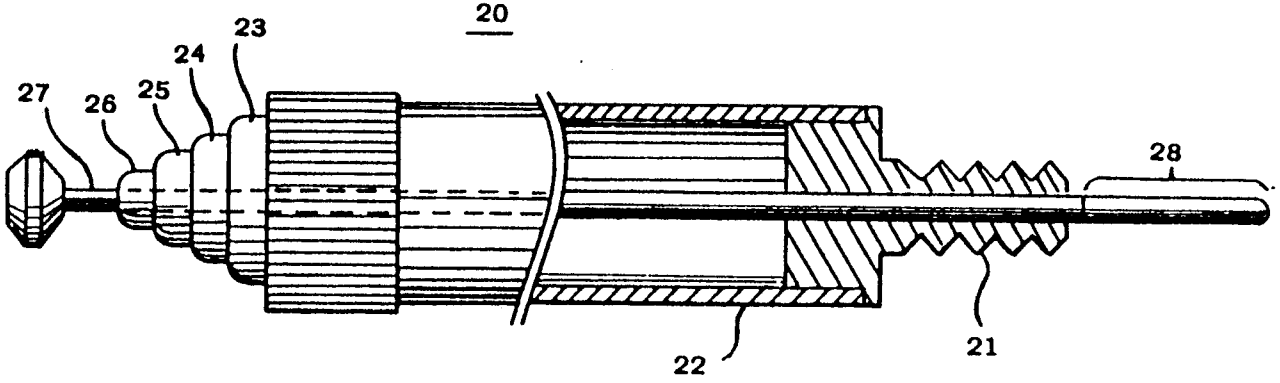
FIG. 2 is a side view of a telescoping antenna in accordance with the invention.
Figure 3:
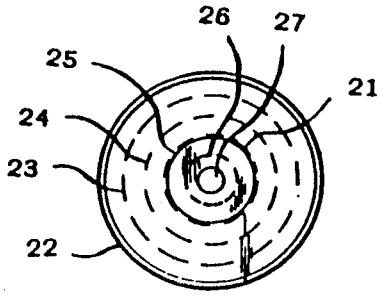
FIG. 3 is an end view of the telescoping antenna depicted in FIG. 2 in accordance with the invention.

Referring next to FIGS. 2 and 3, there is shown a telescoping antenna 20 suitable for use in a portable transceiver for increasing the level of radiated and received r-f energy while in a collapsed position and also obtaining the maximum permitted radiated level of r-f energy while in an extended position.

The antenna is shown in the collapsed position and has a threaded base 21 for mounting or or in the housing of the transceiver. For securing the antenna assembly, this base 21 is affixed to the outer section 22 of multiple cylindrical interlocking sections 22 through 27. In the expanded position, each smaller section of the antenna extends outward from the next larger section in which it is contained until each stop surface provided by an interlock on adjacent surfaces is encountered.

In the collapsed position and in accordance with the invention, the cylindrical section 27 of the antenna 20 is elongated in comparison with the other multiple interlocking sections 22 through 26. When the antenna is pushed down into its collapsed position, a portion 28 of this elongated cylindrical section 27 passes through an opening in the threaded base 21 for projecting outward from this base. This portion 28 of the cylindrical section 27 may be either metallic for completing an electrical circuit path or non-metallic for interrupting an electrical circuit path as desired.

Figure 4:
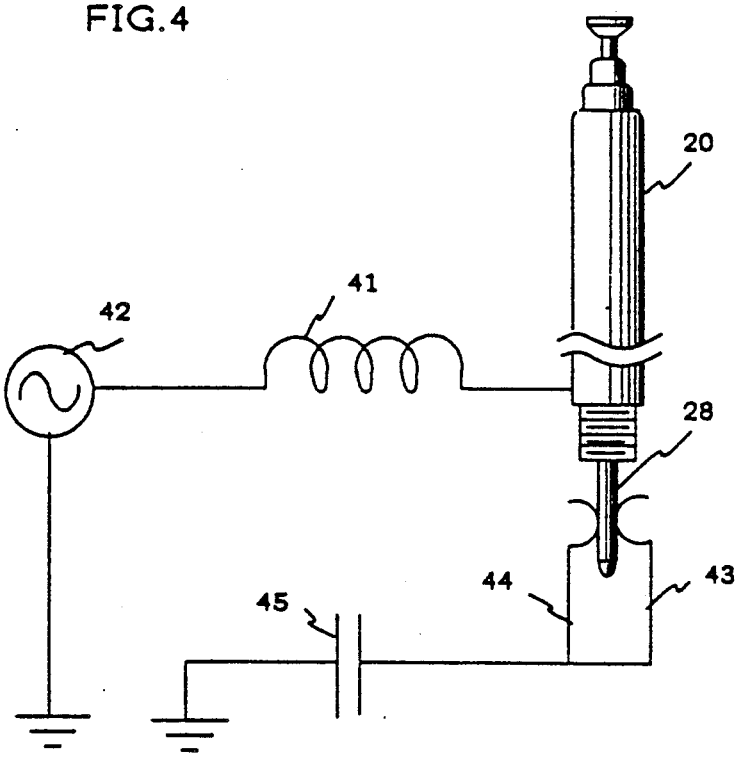
FIGS. 4, 5 and 6 illustratively show the employment of the telescoping antenna along with alternate matching arrangements for achieving increased radiating efficiency while the antenna is in the collapsed position.
Figure 5:
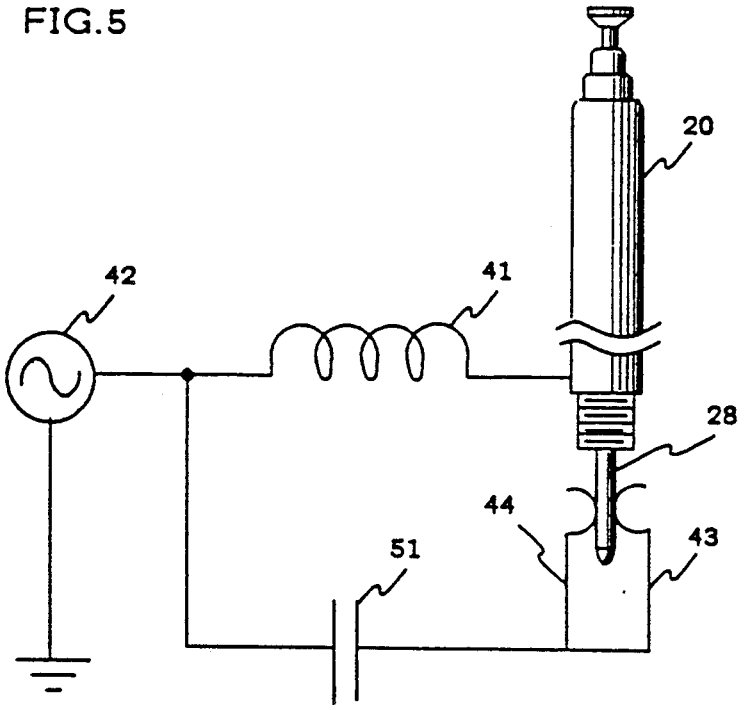
Figure 6:
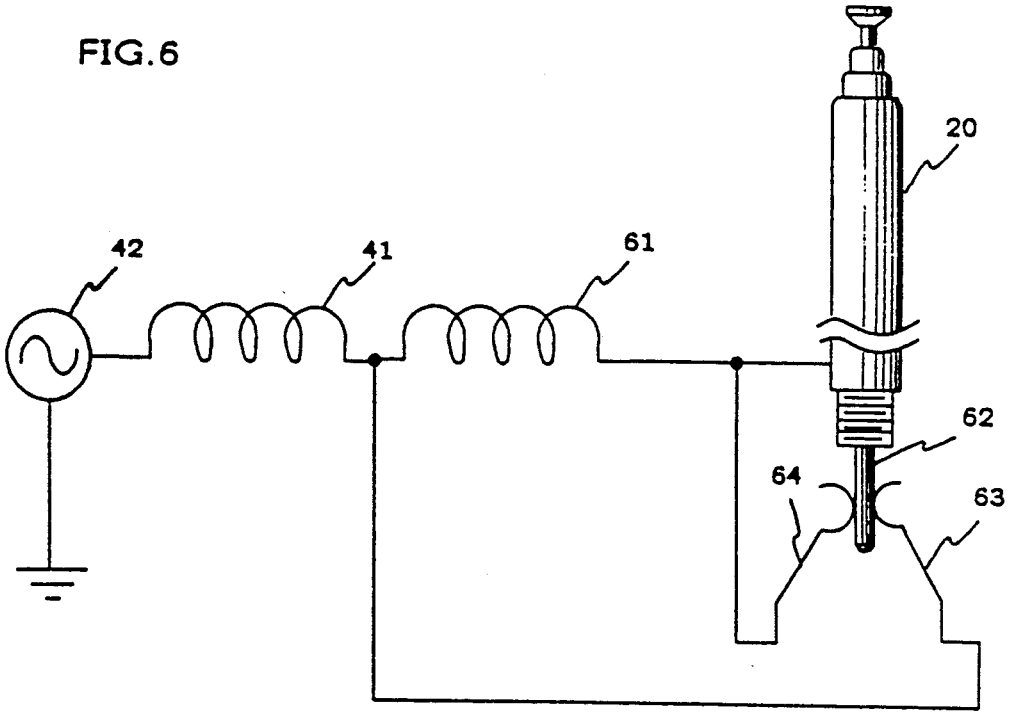

Referring in combination next to FIGS. 4, 5 and 6, there are illustratively shown the telescoping antenna along with alternate arrangements of antenna matching circuitry for achieving efficient radiating of a signal from a signal source while the antenna is in both the extended and the collapsed position. A telescoping antenna, such as antenna 20 is typically three to five times its collapsed length is an extended position. Because such an antenna, in most applications and even in an extended position, is generally shorter than a quarter wavelength as its operating frequencies, its equivalent circuit contains a certain amount of capacitance in series with its radiation resistance. And this capacitance is decreased when the antenna is in the collapsed position. To deliver power efficiently to these two different load impedances, the capacitance reactance is resonated at the operating frequencies by complementary reactive elements provided by the antenna matching circuitry.

With reference first to FIG. 4, antenna 20 is shown in the collapsed position and inductive element 41 provides the electrical connection for coupling r-f signals from the signal source 42 to the antenna 20. When the antenna is in the collapsed position, the protruding rod shaped conductive member 28 extends outward from the base of the antenna and contacts a pair of inwardly biased and opposed upstanding spring members 43 and 44 for causing these spring members to make electrical contact with the antenna. Capacitive element 45 is inserted thereby as a matching reactive element by the rod shaped member 28 contacting spring members 43 and 44. When the antenna is extended, the rod shaped member 28 is removed from contact with the spring members thereby removing the capacitive element 45 from the matching circuitry. The matching element in this latter configuration is then comprised only of inductive element 41 for resonating with the antenna 20.

Referring next to FIG. 5 there is shown an alternative arrangement of antenna matching circuitry for achieving efficiency radiating of a signal from a signal source while the antenna is in both the extended and the collapsed position. The reactive elements employed in this arrangement are inductive element 41, which is connected to and resonates with the antenna in a fully extended position, and capacitive element 51 which along with inductive element 41 resonates with the antenna in a collapsed position. Capacitive element 51 in this arrangement is also connected along with inductive element 41 to the output of the signal source 42.

Referring next to FIG. 6 there is shown yet another alternative arrangement of antenna matching circuit for efficiently matching a signal from the signal source 42 with the antenna 20 while in both the collapsed and the extended position. Included in this arrangement are inductive element 41, a second inductive element 61, a protruding rod shaped non-conducting member 62, and inwardly biased and opposed upstanding spring members 63 and 64. These spring members are biased such that they normally make electrical contact with each other. The protruding rod shaped non-conducting member 62 is extendable outward from the antenna 20 for contacting the spring members 63 and 64 thereby interrupting the electrical contact normally made between these members.

By way of operation, when the antenna 20 is in a collapsed position, a signal from the signal source 62 to the antenna 20 is coupled through inductive element 41 and inductive element 61 for resonating with the antenna while in this position. This signal path is achieved by the rod shaped non-conduction member 62 interrupting the continuity path normally existing between spring members 63 and 64 when it is inserted therebetween. When the antenna is in the extended position and the rod shaped non-conducting member 62 retracted, inductive element 61 is effectively removed from the matching circuit by the alternative signal path provided around this inductive element through the spring members 63 and 64.

Various other modifications of this invention are contemplated and may obviously be resorted to by those skilled in the art without departing from the spirit and scope of the invention as hereinafter defined by the appended claims.

We claim:

1. A telescoping antenna having a plurality of cylindrical interlocking sections including at least a first small diameter section and a second larger diameter section, the small diameter section being coaxially aligned with an disposed in the larger diameter section when the antenna is in a collapsed position and coaxially aligned and projecting outwardly from the larger diameter section in a first direction when the antenna is in an extended position, characterized in that the small diameter section is elongated with respect to the second larger diameter section by affixing a single coaxially aligned cylindrical portion thereto for projecting outwardly from the larger diameter section in a second direction opposite that of the first direction when the antenna is in the collapsed position, the single coaxially aligned cylindrical portion at one end being a free end and at the other end being affixed only to the small diameter section, and being entirely disposed within the large diameter section when the antenna is in the extended position.

2. A method of assembly for a telescoping antenna having a plurality of cylindrical interlocking sections including at least a first small diameter section and a second larger diameter section, the small diameter section being coaxially aligned with an disposed in the larger diameter section when the antenna is in a collapsed position and aligned and projecting outwardly from the larger diameter section in a first direction when the antenna is in an extended position, the improvement comprising the step of elongating the small diameter section with respect to the second larger diameter section by affixing a single coaxially aligned cylindrical portion thereto for projecting outwardly from the larger diameter section in a second direction opposite that of the first direction when the antenna is in the collapsed position, the single coaxially aligned cylindrical portion at one end being a free end and at the other end being affixed only to the small diameter section, and being entirely disposed within the large diameter section when the antenna is in the extended position.

* * * * *